United States Patent [19]

Kaye

[11] 4,431,135

[45] Feb. 14, 1984

[54] AIR NOZZLE AND METHOD

[76] Inventor: Richard G. Kaye, 154 Sunrise Hill Rd., Norwalk, Conn. 06851

[21] Appl. No.: 324,795

[22] Filed: Nov. 25, 1981

[51] Int. Cl.[3] ..... B05B 7/06

[52] U.S. Cl. ..... 239/8; 239/425; 239/552; 239/DIG. 7; 239/DIG. 21; 417/54; 417/197; 417/198

[58] Field of Search ..... 239/425, 600, 434.5, 239/552, DIG. 7, DIG. 21, DIG. 22, DIG. 16, 17, 1, 8; 417/54, 187, 197, 198

[56] References Cited

U.S. PATENT DOCUMENTS

| | | | |
|---|---|---|---|
| 2,320,964 | 6/1943 | Yates | 239/291 |
| 3,706,415 | 12/1972 | Hruby, Jr. | 239/552 |
| 3,735,778 | 5/1973 | Garnier | 239/DIG. 7 |
| 3,984,054 | 10/1976 | Frochaux | 239/DIG. 21 |
| 3,985,302 | 10/1976 | Frochaux | 239/DIG. 21 |
| 4,060,874 | 12/1977 | Furutsutsumi | 239/DIG. 22 |
| 4,195,780 | 4/1980 | Inglis | 239/433 |
| 4,204,631 | 5/1980 | Hruby, Jr. | 239/DIG. 16 |
| 4,300,033 | 11/1981 | Scarton et al. | 239/DIG. 7 |

*Primary Examiner*—John J. Love
*Assistant Examiner*—Michael J. Forman
*Attorney, Agent, or Firm*—Thomas L. Tully

[57] ABSTRACT

Efficient and silent air nozzle assembly for discharging a small amount of compressed gas, such as air, to entrain a larger amount of secondary air and direct or focus the composite air mixture against a work station, such as for cleaning or ejection purposes. The air nozzle comprises a conduit having an exit orifice into which is pressed a solid nozzle plug having a multiplicity of peripheral longitudinal surface recesses which provide a multiplicity of small gas passages between the plug and the inner surface of the conduit. The plug has an inwardly tapered tip which extends out of the exit orifice of the conduit to cause the exiting gas to entrain surrounding or secondary air and direct the gas-air mixture along the tapered surface thereof where it converges as a concentrated air flow.

6 Claims, 4 Drawing Figures

AIR NOZZLE AND METHOD

BACKGROUND OF THE INVENTION

The present invention relates to novel air nozzles and to the method for producing such nozzles which are useful for a variety of purposes, most particularly for industrial applications such as blowing dust or scraps away from a work station, cleaning parts, ejecting molded parts from a cavity, etc.

A variety of air nozzles are commercially-available for purposes of concentrating or directing the flow of a compressed gas, such as air, and/or entraining surrounding or secondary air to augment and conserve the compressed gas and/or to reduce the noise volume of compressed gas as it exits the orifice of the conduit.

Such air nozzles generally are relatively expensive machined parts including two or more elements which are threadably-engaged and which include a central bore and/or air slots or passages. Such nozzles are expensive to produce and can become plugged with dirt or metal or plastic chips or dust entrained from the surrounding air, particularly in cases where the surrounding air is drawn into the nozzle as a feature of its structure and operation.

Reference is made to U.S. Pat. No. 3,795,367 which relates to a compressed air nozzle for entraining secondary air by the Coanda effect and discharging the composite gas as a wide diverging flow.

Reference is also made to U.S. Pat. Nos. 2,320,964 and 4,060,874, both of which relate to nozzles for discharging compressed air for purposes of blowing dust or particles from a work area. In each case multi-piece adjustable nozzles are used to provide a secondary discharge of compressed air to form an air curtain which confines the dust or particles which are agitated by the primary discharge of compressed air.

Reference is also made to U.S. Pat. No. 2,468,824 which relates to a multi-piece cutting tip nozzle for mixing oxygen and propane or acetylene in a gas torch, and to U.S. Pat. No. 3,640,472 which relates to a spray nozzle for a water fountain, and to British Pat. No. 173,901 which relates to an adjustable nozzle for a gas burner.

The foregoing references do not teach or suggest simple, inexpensive compressed gas nozzles which are quiet in operation, which conserve the compressed gas by entraining secondary air or which direct or focus the composite air discharge to prevent agitation in surrounding areas.

In many instances air nozzles are not used at all on compressed air conduits used for cleaning or ejection purposes, because of the expense and problems involved. The straight gas conduit is used without any nozzle attachment. However, this creates additional problems because the compressed gas flow is not concentrated or direct, does not entrain surrounding air and emits a loud sound which is distracting and can cause loss of hearing over an extended period of time.

SUMMARY OF THE INVENTION

The present invention relates to novel air nozzles comprising plug elements which are simple and inexpensive to produce and which can be press-fitted into the end of a compressed gas conduit, such as thin copper tubing, adjacent the exit orifice thereof to provide said air nozzles which perform at least three functions which are not performed by the gas conduit, per se.

Such inserts, because of their shape and function, substantially silence or muffle the sound of the compressed gas emitted by the conduit, create a vacuum so as to draw in or entrain a substantial volume of surrounding or secondary air and thereby conserve the volume of compressed gas which must be released to perform the desired function, and cause the emitted compressed gas and secondary air to converge at the tip of the plug element as a composite converging air flow which can be focused or aimed at a desired work area.

BRIEF DESCRIPTION OF THE DRAWING

In the accmpanying drawing:

FIG. 1 illustrates a novel nozzle assembly 10 comprising a nozzle plug element 11 press-fitted within a complimentary compressed gas conduit section 12, adjacent the exit orifice 13 thereof. The plug element 11 of FIG. 1 comprises a short length of solid hexagonal, smooth metal stock, such as brass or stainless steel, having six longitudinal flat outer surfaces or flats 14 which merge into a conical tip 15 which is truncated at 16. The maximum outer diameter of the plug element, i.e., the distance "d" between opposed crests or high areas, as shown in FIGS. 2 to 4, is equal to or slightly greater than the inner diameter of the hollow gas conduit 12 so that the plug element 11 can be pressed into the exit orifice 13 of the conduit section 12 and will remain tightly frictionally-engaged in the position shown in FIG. 1, resistant to dislodgement under the force of the compressed gas thereagainst.

Figure 1:
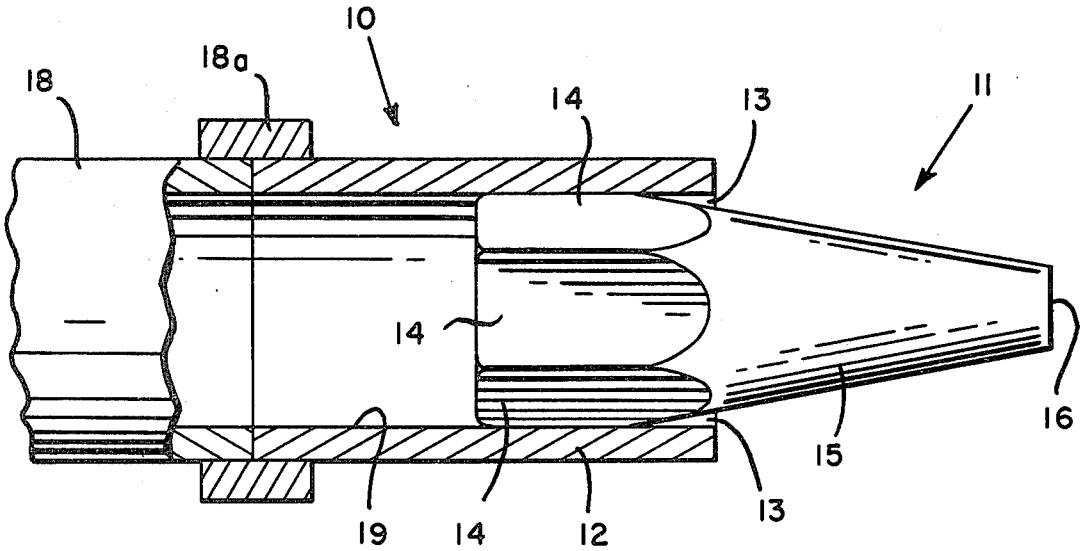
FIG. 1 is a longitudinal vertical view, in partial section, illustrating an air nozzle assembly comprising a nozzle plug element press-fitted within a compressed gas conduit, adjacent the exit orifice thereof, according to one embodiment of the present invention.

In the embodiment of FIG. 1, the nozzle plug element 11 is pressed within the exit orifice 13 of the conduit section 12 a sufficient distance that the conical tip 15 extends within the exit orifice 13 and the flats 14 open onto the surface of the conical tip 15 at a point slightly inwardly of the exit orifice 13. This creates longitudinal narrow gas passages 17, shown in FIG. 2, between the flats 14 and the interior wall 19 of the conduit section 12. The accelerated compressed gas flowing through the narrow gas passages 17 is of lower pressure than the surrounding or ambient air at the exit orifice 13. This high velocity, low pressur air flow draws in a substantial volume of surrounding air to form a combined air flow greater than that released from the nozzle, per se. This combined flow is in a direction inwardly against the conical surface 15 which causes the mixture of compressed gas and entrained surrounding air, containing a major amount by volume of the latter, to flow at high velocity inwardly towards the tip 16 of the nozzle plug element 11. This causes the combined flow to be concentrated just beyond the tip of the plug element to provide a thin air flow mixture which can be focused upon a small area for maximum precision, efficiency and safety. In the absence of the plug element the conduit will discharge a wide flow of compressed gas which will dissipate outwardly, will not entrain secondary air and will emit a loud noise. Since the wide gas flow is dissipated and consists solely of compressed gas, more compressed gas must be consumed to perform a desired function. Also the performance cannot be localized or confined to a small area without also disturbing dust, dirt, metal particles or shavings, etc., in surrounding areas, thereby causing an undue contamination of the airspace and a greater health and safety hazard to workers than is the case when the air flow can be concentrated or focused upon a smaller area to be cleaned.

Figure 3:
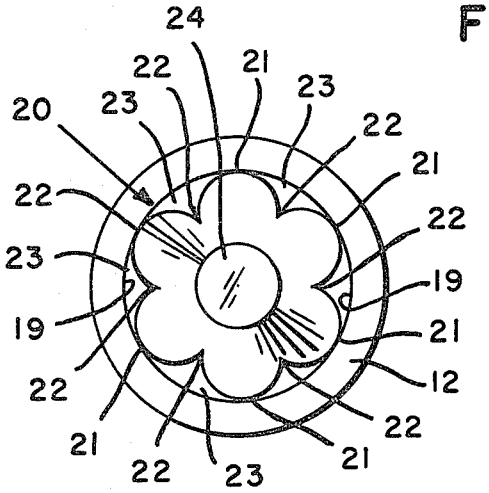
FIGS. 3 and 4 are views, corresponding to FIG. 2 but illustrating air nozzle assemblies comprising nozzle plug elements having longitudinal ribs and longitudinal grooves, respectively, according to other embodiments of the present invention.

FIG. 3 illustrates a nozzle plug element 20 inserted within the exit orifice of a compressed gas conduit section 12 according to another embodiment of the invention. The plug element 20 is similar to element 11 of FIG. 1 and positioned within, at, or adjacent the exit orifice of the conduit section 12. Element 20 comprises a multiplicity of continuous longitudinal ridges 21 forming therebetween a multiplicity of longitudinal grooves or valleys 22 which form between themselves and the interior surface 19 of the conduit 12 a multiplicity of small compressed gas passages 23 which open or merge in advance of, at, or immediately beyond the exit orifice of the conduit 12. The combined gas flow therefrom flows inwardly towards and off the truncated tip 24 of the nozzle plug element 20.

Figure 2:
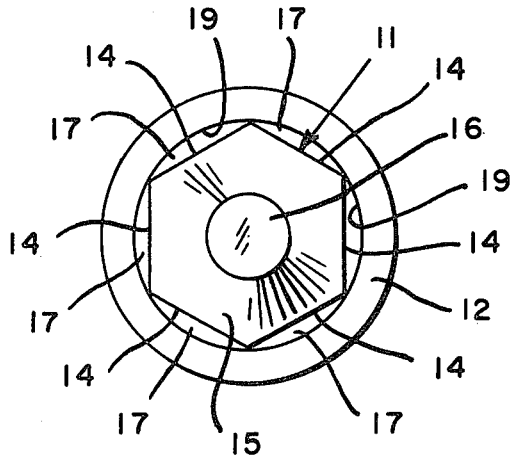
FIG. 2 is a front plan view of the air nozzle assembly of FIG. 1.
Figure 4:
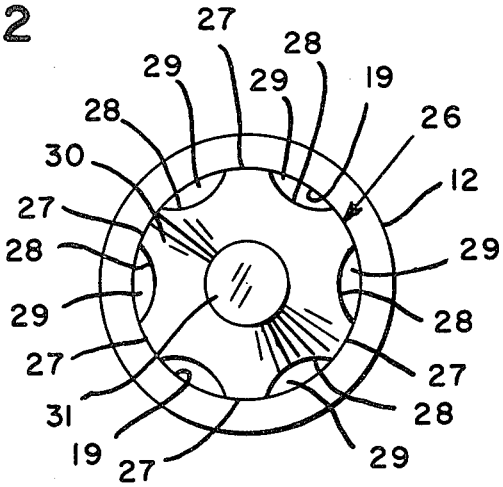

FIG. 4 illustrates another nozzle plug element 26 which is similar in location and function to those of FIGS. 1 to 3. Plug element 26 has a round outer surface 27 into which is cut a multiplicity of continuous longitudinal concave gooves 28 which form between themselves and the inner surface 19 of conduit 12 a multiplicity of continuous longitudinal compressed gas passages 29. The passages 29 open or merge onto the inward taper of the conical section 30 which terminates in a truncated tip 31.

As will be clear in view of the present disclosure, the novel nozzle assemblies of the present invention may be produced from compressed gas conduits and nozzle plug elements of various sizes depending upon the required air flow volume. For precision work where only a small air flow volume is required, the conduit may comprise a length of cylindrical copper tubing having an outer diameter of about 0.187 inch and an inner diameter of about 0.141 inch. The plug insert may be cut from a rod of solid material such as metal or plastic, the rod having a multiplicity of longitudinal flat surfaces, such as hexagonal or other polygonal stock, which permit a compressed gas to flow therethrough when the plug element is tightly frictionally engaged by the inner surface of a gas conduit such as thin metal or plastic tubing. The longitudinal flats provide a multiplicity of small or narrow gas passages between the plug element and the inner surface of the gas conduit so that the exiting compressed gas is emitted at a very high velocity as a multiplicity of streams which converge or expand together to form a continuous ring of compressed gas immediately in advance of the exit orifice of the conduit. This gas flow is at a pressure lower than the surrounding air due to its acceleration. This causes the surrounding air to be drawn into the high velocity flow. The combined mixture follows the tapered surface of the conical tip by what is known as the Coanda effect causing a convergent high velocity mixture of compressed and entrained air immediately in front of the conical tip.

Obviously, the maximum outer diameter of the nozzle plug elements used according to the present invention will depend upon the inner diameter of the compressed gas, normally compressed air, conduit sections 12 into which they are to be inserted. For example, the nozzle elements to be used with the small narrow copper tubing discussed hereinbefore, i.e., having an inner diameter of about 0.141 inch, may be produced from $\frac{1}{8}$ inch hexagonal brass of stainless steel stock having a maximum diameter of 0.144 inch and a minimum diameter, from flat-to-flat, of $\frac{1}{8}$ inch or 0.125 inch. The plug element is pressed into the slightly smaller opening of the conduit to form a firm attachment in the position illustrated by FIG. 1. This provides six gas passages, each having a maximum space width, between the center of the flat 14 and the radially-opposed inner surface 19 of the conduit 12, of about 0.016 inch. Obviously, the width of the passages will increase proportionately with the use of conduits and plug elements of larger dimensions or with plug elements having deeper grooves or having a less number of flats, i.e., square stock.

The present longitudinal grooves, recesses or ridges preferably are straight but can be of spiral configuration so long as they open inwardly of, at, or just beyond, the exit orifice of the conduit, i.e., adjacent thereto, and onto the tapered surface of the plug element.

The present air nozzle assemblies may be pre-formed as nozzle attachments for existing compressed gas conduits. For example, a nozzle assembly comprising a short length of conduit section 12, i.e., a sleeve about one or two inches in length, having inserted therein a plug element 11, may be attached to the end of an existing conduit 18 by means of an outer sleeve length or collar **18*a* which provides tight frictional engagement therebetween, as illustrated by FIG. 1 of the drawing. Alternatively, the outer sleeve length 18*a* may threadably engage one or both lengths 12 and 18 of conduit or may be soldered to one or both lengths 12 and 18 of conduit. As yet another alternative, the nozzle assembly 10 may comprise a short length of conduit 12 having an outer or inner diameter which permits it to be frictionally or threadably engaged over or within the exit orifice of the compressed gas conduit 18**.

Variations and modifications of the present invention will be apparent to those skilled in the art within the scope of the present claims.

I claim:

1. An air flow nozzle assembly for emitting a compressed gas, entraining surrounding air and causing the gas-air mixture to converge as a relatively silent, concentrated air flow, which comprises a round-tubular conduit section adapted to transmit a supply of a compressed gas and having an exit orifice of round cross-section, and a unitary solid plug element, a portion of said plug element having a polygonal cross-section which is press-fitted within said conduit and tightly frictionally-engaged adjacent the exit orifice thereof, said portion having a multiplicity of continuous longitudinal uniform flat surface along the outer surface thereof which form between themselves and the inner surface of said conduit a multiplicity of small gas passages, said plug element also having a tapered tip at least a portion of said tapered tip which extends beyond said exit orifice, whereby the passage of compressed gas at high velocity through said gas passages causes the entrainment of surrounding air at said exit orifice to form a gas-air mixture which flows over the tapered tip of said plug element and converges as a concentrated air flow mixture.

2. A nozzle assembly according to claim 1 in which said plug element comprises a short length of solid metal having a truncated conical tip.

3. A nozzle assembly according to claim 2 in which said metal plug element has a maximum outer diameter which is slightly greater than the inner diameter of the conduit to provide tight frictional engagement therebetween.

4. A nozzle assembly according to claim 1 in which the conical tip of said plug element extends out of said conduit section from a point inwardly of the exit orifice thereof.

5. A method for modifying a round-tubular compressed gas conduit to reduce the noise of compressed gas flowing from the exit orifice thereof, to cause said gas to entrain a substantial volume of surrounding air to form a gas-air mixture and to cause said mixture to converge as a concentrated air flow, which comprises providing a unitary solid nozzle plug element, a portion of said plug element having a polygonal cross-section, said portion having a multiplicity of continuous longitudinal uniform flat surfaces along the outer surface thereof and having a tapered tip onto which said surface open, and press-fitting said plug element into tight frictional engagement within the exit orifice of the compressed gas conduit, so that said longitudinal flat surfaces form between themselves and the inner surface of said conduit a multiplicity of small continuous longitudinal gas passages, and at least a portion of the tapered tip of said plug element extends beyond the exit orifice of said conduit section, whereby compressed gas passing through said conduit section and said gas passages entrains a large volume of surrounding air at said exit orifice to form a gas-air mixture which flows inwardly over the surface of said tapered tip and converges as a concentrated air flow.

6. Method according to claim 5 in which said plug element has a maximum outer diameter which is slightly larger than the inner diameter of said conduit section.

* * * * *